United States Patent [19]

Croft

[11] 4,086,663

[45] Apr. 25, 1978

[54] MIXING APPARATUS AND METHOD

[75] Inventor: Peter Croft, Ilkley, England

[73] Assignee: Allied Colloids Limited, Bradford,, England

[21] Appl. No.: 696,172

[22] Filed: Jun. 15, 1976

[30] Foreign Application Priority Data

Jun. 21, 1975 United Kingdom ..... 26465/75

[51] Int. Cl.[2] ..... B01F 15/02

[52] U.S. Cl. ..... 366/154; 366/165; 366/173; 366/177

[58] Field of Search ..... 259/4 R, 18, 4 A, 4 AB, 259/4 AC, 2, 36, 60; 239/561, 567, DIG. 13

[56] References Cited

U.S. PATENT DOCUMENTS

| | | | |
|---|---|---|---|
| 1,686,078 | 10/1928 | Evans | 259/4 R |
| 1,803,425 | 5/1931 | Cunningham | 239/DIG. 13 |
| 2,528,514 | 11/1950 | Harvey | 259/4 R |
| 2,653,801 | 9/1953 | Fontein | 259/4 R |
| 2,724,580 | 11/1955 | Revallier | 259/4 R |
| 2,746,728 | 5/1956 | Pomerleau | 259/4 R |
| 2,900,176 | 8/1959 | Krogel | 259/4 R |
| 3,707,829 | 1/1973 | Siegel | 259/18 |
| 3,741,533 | 6/1973 | Winn | 259/4 R |
| 3,794,299 | 2/1974 | Wagner | 259/4 R |
| 3,840,213 | 10/1974 | Kormos | 259/9 |

*Primary Examiner*—Robert W. Jenkins

[57] ABSTRACT

A method and apparatus for dispersing a particulate solid uniformly in a liquid are described. The apparatus comprises a duct open at one end with a central inlet at the other end through which the solids are fed entrained in a stream of gas, and a plurality of liquid sprays arranged around this inlet. The particles are wetted as they travel through the duct by the mist particles generated by the sprays and they emerge from the open end of the duct and pass into the liquid in which they are to be dispersed.

11 Claims, 6 Drawing Figures

MIXING APPARATUS AND METHOD

The invention relates to the mixing of a finely divided solid particulate material into a liquid, and to apparatus for this. The invention is of particular value when dissolving polymers, especially synthetic ones, in a liquid, commonly water. The invention is especially applicable to the mixing of flocculants into liquids, flocculants commonly being solid particulate, high molecular weight, water-soluble polymers.

Solid particulate polymers have certain advantages as to ease of handling and storage as compared with polymers in solution form. However, solid particulate polymers are more difficult to mix and dissolve in liquids as is necessary when, for example, they are to be used as flocculants and must be dissolved at low concentrations in an aqueous suspension in a tank or in a flowing stream. On contact with a solvent, e.g. water, particles of solid materials that yield viscous solutions immediately become tacky and if the particles are added in bulk to the solvent roughly spherical aggregates of the particles tend to form, commonly from one millimeter to several centimeters in diameter, and whilst the exterior of these aggregates is thoroughly wetted the centres are often still dry and powdery. The aggregates or lumps are exceedingly difficult to dissolve and their presence means that pre-determined and uniform concentrations cannot be obtained. Also, the lumps can cause subsequent processing problems unless removed e.g. by filtration: whether or not the lumps are removed there is a loss of effective material. The effectiveness of flocculants is concentration-dependent and thus loss of effective material is a serious problem since, after taking economy into account, only quite narrow concentration ranges are feasible.

Various devices have been used in commercial practice in attempts to avoid the above problems. In one such device the solid particles are sucked into a rapid flow of water by an eductor. In another such device the particles are added into the water where it is generated into the form of a vortex, the addition often being by hand. These devices are not entirely satisfactory; in particular they tend to result in lump formation or other non-uniform mixing and, especially in the case of the hand operated vortex generator, they are time-consuming.

A device according to the invention comprises a duct open at a first end, a solids inlet for feeding particulate solids entrained in a stream of gas centrally into the duct at or near its second end with a direction of flow generally towards the first end, and a plurality of sprays arranged around the second end for spraying liquid into the duct as a spray of mist particles that substantially fills the width of the duct and that travels generally towards the first end.

In use, apparatus is assembled comprising a vessel which can contain the liquid into which the solids are to be mixed and the device, the device being mounted with the first end of the duct in or over the vessel. The device is generally mounted vertically and in any event should be mounted in such a manner that the solids can pass directly from the open, first, end of the duct into the liquid in the vessel, preferably without contacting any surface of the apparatus.

In use the vessel is at least partially filled with the liquid into which the solids are to be mixed, the solids are wetted with the same liquid or with a compatible liquid by feeding them through the solids inlet of the device and through the duct into which the liquid or compatible liquid is being sprayed, and allowing the wetted solids to fall into the liquid in the vessel.

By use of the device the individual solid particles can be very effectively and individually wetted and the wetted individual particles can be rapidly dispersed in the chosen liquid to give a uniform concentration throughout the liquid of dissolved material even under conditions of minimal stirring.

The essence of the invention is that the particles are wetted with liquid while both the particles and the liquid are entrained or at least partially suspended in a gas, usually air. Thus in the invention the wetting is achieved by contact between the solid particles and particles of liquid in the form of mist. This gives much better results than when wetting is achieved by contact between the solid particles and a bulk liquid, such as a vortex obtained by directing powerful water streams into the duct or when the solids are allowed to fall into a vessel of water, for instance a vortex.

As a result of contacting the particulate solids entrained in a gas stream with a spray of mist particles of liquid, instead of contacting them with a stream or body of liquid, the particles are partially suspended or entrained in a gaseous medium when they emerge from the first end of the duct. Thus they do not emerge from the duct as a dispersion of solid particles in a liquid stream but unstead emerge as a gaseous stream, a substantial proportion of the volume of the stream, usually at least 30%, preferably at least 50% and most preferably at least 70%, being of gas.

It is necessary to ensure that the particles pass towards the first end of the duct. The predominant motion of the particles is preferably due to entrainment in the gas stream, combined with the effect of gravity if the duct is mounted vertically. The component of the movement of the particles that is due to the impingement of the liquid droplets of the spray upon the solid particles is preferably negligible.

The solids inlet for feeding particulate solids entrained in a stream of gas into the duct is a feeder tube that discharges into the duct either at the second end or, more preferably, near the second end, downstream from it (i.e. towards the first end). The feeder tube must have sufficient diameter to permit the stream of gas and solids to pass through it with the solids entrained in the gas stream. Generally the diameter is at least 1 cm, preferably at least 2 cm. The gas is generally air. Entrainment can be effected by conventional means e.g. by sucking up the particles in a stream of air and passing the air with suspended particles through a fan and then on to the mixing zone. Alternatively, the particles may be fed into an air stream using a rotary valve or venturi type feed system.

The device is preferably such that the particles emerge into the mixing zone with a swirling motion as this assists rapid and uniform contact between the particles and the spray droplets in the mixing zone. Means for injecting the solids through the solids inlet into the duct with a swirling action may comprise the use of deflecting vanes in the solids inlet, e.g. in the feeder tube, or by having a passage of substantially circular cross-section leading to the inlet feeder tube and means for injecting the solids entrained in air tangentially into the passage. Thus a cyclone may be fitted above the feeder tube.

The end of the feeder tube is preferably chamfered so as to minimise the tendency for any spray droplets to enter the inside of the tube and possibly thereby cause particles to adhere to the inside of the feeder tube. Furthermore, the feeder tube is desirably of transparent material e.g. transparent plastics material so that any blockage can easily be seen.

Generally at least three sprays are arranged around the second end. The sprays move generally towards the first end, preferably with a motion substantially parallel to the axis of the duct, and the effect of having a plurality of them around the inlet is to produce what can conveniently be considered to be initially a generally annular turbulent spray curtain but which is sufficiently turbulent and diffuse that the spray of mist particles substantially fills the width of the duct within quite a short distance from the second end, and in any event well before the first end is reached. It is particularly preferred that the solids inlet, that is to say the outlet point from the feeder tube, should be positioned centrally in the duct near but downstream from the second end and the liquid sprays should be positioned in the second end or between the second end and the solids inlet. This facilitates the building up of a highly effective spray before the spray comes into the contact with the particles. Thus, at the effective mixing zone the space is saturated with the spray in consequence of the merging of the sprays from the individual nozzles to form a uniform curtain or blanket of spray.

The spray nozzles may be such as to produce full cone or hollow cone sprays and the cone angles are preferably from 5° to 50°, most preferably 10° to 30°. The orifice diameter of the nozzles is usually from 1.6 mm to 16 mm, preferably 1.6 mm to 10 mm, most preferably 3.1 mm to 6.2 mm. The diameter of each orifice is usually less than the diameter of the solids inlet, and often the area of the solids inlet orifice is more than the total of the areas of the spray orifices. Combinations of full cone and hollow cone nozzles can be used as can nozzles giving different spray angles. For example, eight spray nozzles may be used in an annular array around the feeder tube, nozzles giving a 15° spray angle alternating with nozzles giving a 25° spray angle. Arrangements such as this are preferred where there is any tendency for the particles to stick to the walls of the tube enclosing the mixing zone since the wider sprays serve to drench the walls of the tube with liquid and thereby wash off adhering particles whilst the narrower sprays prevent any back-flow of the particles.

The spray nozzles may project rather than simply being suitably shaped holes in a plate and in this case there may be one or more lateral openings in addition to the terminal axial opening. Designing the sprays to spray transversely to the duct, e.g. in this manner, as well as along the duct, is of value if there is any tendency for particles to accumulate in the device upstream of the point at which the particles are discharged since the lateral spray serves to wash the particles back downstream.

The duct is preferably of transparent material.

The optimum operating conditions for the device for any particular circumstances can easily be determined by simple experiment. Commonly the overall diameter of the duct will be from 5 to 30 centimeters and its overall length from 20 centimeters to 1 meter and for devices of this order of size flow rates for the particulate material in the range of 50 grams per minute up to 10 kilograms per minute will generally by suitable. The flow rate for the air or other entraining gas should simply be sufficient to convey the particles. Commonly flow rates for the liquid will vary from a few liters per minute up to 500 liters per minute. The ratio of the rate of flow of liquid to the rate of flow of entraining gas must be sufficient to ensure that the solid particles are travelling through a substantially gaseous medium, as described above, when they leave the duct such that they are not in a substantially liquid medium. Generally this condition is observed if the volume of liquid per unit time is less than 10% of the volume of air or other entraining gas per unit time passing through the duct. Preferably the weight ratio of liquid : solids is less than 300 : 1 but preferably it is at least 30 : 1. Best results are achieved with a ratio of from 50 to 200 : 1, e.g. 100 : 1. Preferably particles emerging in the gaseous medium from the first end of the duct are travelling at at least 10 feet per second.

The invention is further described with reference to the accompanying drawings in which.

Figure 1:
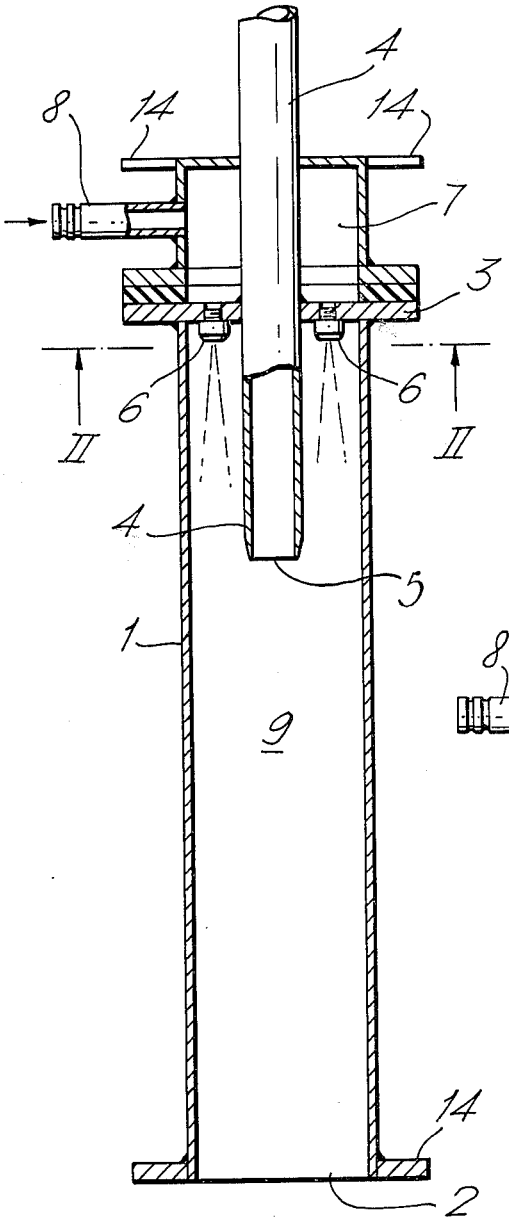
FIG. 1 is a longitudinal cross-section through a mixing device according to the invention.
Figure 2:
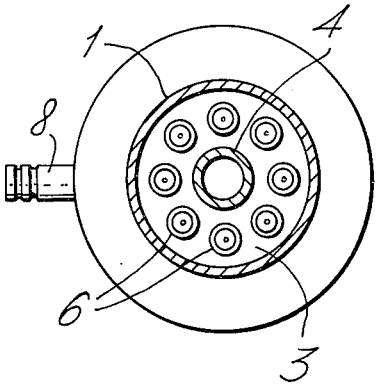
FIG. 2 is a transverse cross-section along the line I—I of the device of FIG. 1.

Referring to FIGS. 1 and 2, the device comprises a generally cylindrical duct 1 open at its first end 2 and closed at its second end 3 and having a feeder pipe 4 leading centrally through the second end. This feeder tube is chamfered at its lower end 5, this end serving as the discharge point for solids inlet entrained in a gas stream. Eight liquid spray nozzles 6 are positioned around the feeder tube and liquid is supplied to them by chamber 7 with which they communicate and to which liquid is supplied through duct 8.

Solids entrained in gas enter the duct 1 through the chamfered tip 5 while liquid is sprayed through sprays 6. Thorough mixing of the solids with the liquid occurs in the mixing zone 9 and wetted solids suspended in and carried by a moving gas stream containing also water particles emerges through the open end of the duct 2.

Figure 3:
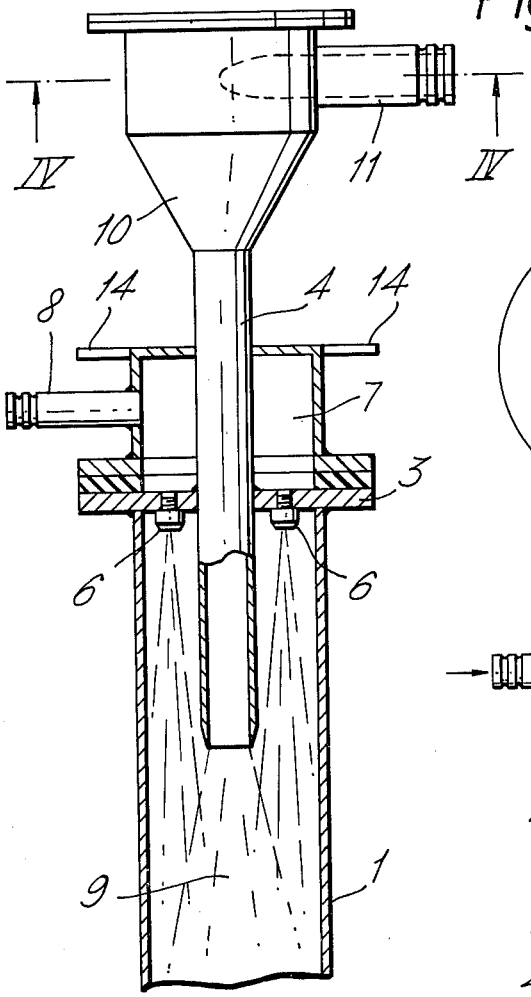
FIG. 3 is a longitudinal cross-section through a mixing device according to the invention showing a cyclone type feed system for the solid particles.
Figure 4:
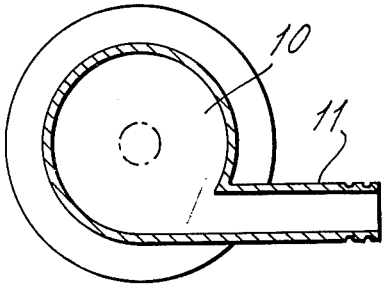
FIG. 4 is a cross-section along the line IV—IV of FIG. 3.

The apparatus shown in FIGS. 3 and 4 is similar to that shown in FIGS. 1 and 2 except that instead of there being eight sprays 6 there may be, for instance, six equally distributed around the feeder tube and except there is a cyclone arrangement leading to the feeder tube. This cyclone arrangement comprises a passage 10 of substantially circular but decreasing cross-section leading to the feeder tube 4 and a feed pipe 11 for injecting solids entrained in air tangentially into the passage 10.

Figure 5:
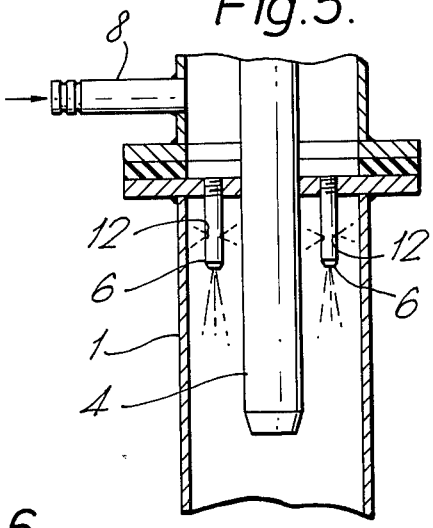
FIG. 5 is a detail of an alternative nozzle arrangement which may be present in the device of FIG. 3.

In the modification shown in FIG. 5 spray nozzles 6 extend sufficiently far down from the first end 3 of the duct to permit openings 12 to be formed in them for spraying transversely across the top of the duct.

In yet another modification, not shown, instead of providing the nozzles 6 beneath the plate defining the second end 3 of the duct the nozzles may be formed in the plate itself.

Figure 6:
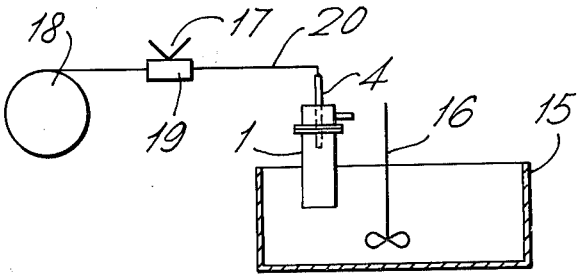
FIG. 6 is a diagramatic representation showing the device according to the invention in use.

As shown in FIG. 6, in use the tube 1 is conveniently fitted vertically in or over a vessel 15 provided with any convenient stirring means shown diagramatically as a propeller 16. Powdered solids are supplied to a hopper 17 and air or other gas is forced by a blower 18 into an eductor 19 associated with the hopper so as to entrain solids in the gas stream and carry it through the duct 20 to the feed tube 4, generally via a cyclone arrangement 10.

The vessel 15 may be charged with liquid batchwise, the vessel for instance being a tank, or the vessel 15 may be one through which the liquid into which the solid particles are to be added and dissolved passes continuously. For instance the vessel 15 may in fact be a pipe or duct through which liquid is passing continuously, in which event the turbulence of the liquid passing through the duct may obviate the need for additional stirrer means 16.

Any convenient means 14 for fixing the device in position may be provided. For example a flange may be provided around the base of the tube or a flange, or more preferably ears, may be provided at the top of the device and provided with bolt holes to permit it being bolted into position.

It is generally convenient that the liquid sprayed through the nozzles 6 should be the same as the liquid in the vessel 15, and generally both are water. However any liquid can be sprayed through the nozzles 6 that is compatible with the liquid 15, the overall objective merely being that the solids should be wetted with a liquid so as to facilitate their individual dissolution into the liquid in the vessel 15.

Instead of using water, organic liquids can be used.

The following is an Example of the invention carried out using apparatus as shown in FIG. 6 with a device as shown in FIGS. 3 and 6 having eight spray nozzles.

A wetting device as shown in FIG. 1 had four 15° spray nozzles and four 25° spray nozzles 6 with orifices of 9.4 centimeters alternately and evenly spaced around a 7.6 mm. diameter circle. The diameters of the powder feeder tube 4 and of the enclosing Perspex duct 1 were 2.5 cm. and 10.5 cm. respectively. 10 kg of Magnafloc bead flocculant was fed from a hopper 17 into an eductor 19 for entrainment in a flow of air of 300 cubic ft/min. produced by a fan blower 18. The powder/air mixture was conducted to the feeder tube via a tangential entry head 10 to produce a swirling motion in the feeder tube.

The water spray was produced by a flow of 150 liters per minute of water at a pressure of 25 psi.

The water/flocculant mixture collected in a mixing tank 15 was stirred at a slow speed by stirrer 16, the particles completely dissolving after 15 minutes giving a solution concentration of 1% without formation of lumps.

I claim:

1. A device comprising a duct open at a first end, a solid inlet for feeding particulate solids entrained in a stream of gas centrally into the duct at or near its second end with a direction of flow generally towards the first end, a plurality of sprays arranged around said solid inlet for spraying liquid into the duct as a spray of mist particles that substantially fills the width of the duct and that travels generally towards the first end and means for injecting said solids through said solids inlet into the duct with a swirling action.

2. A device according to claim 1 in which the solids inlet is positioned centrally in the duct near the second end and the liquid sprays are positioned in the second end or between the second end and the solids inlet.

3. A device according to claim 1 in which the solids inlet is positioned centrally in the duct near the second end and the liquid sprays are designed also to spray liquid transversely to the duct so as to wash solids away from the second end.

4. A device according to claim 1 wherein said means for injecting the solids through the inlet into the duct with a swirling action comprises a passage of substantially circular cross section leading to the inlet and means for injecting solids entrained in air tangentially into the passage.

5. A device according to claim 1 including means for entraining the solids in a stream of gas for feeding them to the solids inlet.

6. Apparatus comprising a device according to claim 1 mounted with the first end of the duct in or over a vessel which can contain liquid.

7. Apparatus according to claim 6 in which the duct is mounted vertically.

8. A method of distributing particulate solids in a liquid uniformly, which method comprises using an apparatus comprising a duct open at a first end, a solid inlet for feeding said particulate solids entrained in a stream of gas centrally into said duct at or near its second end with the direction of flow generally towards said first end, and a plurality of sprays disposed around said solid inlet for spraying liquid into said duct as a spray of mist particles that substantially fills the width of said duct and travels generally towards said first end, said duct being mounted over a vessel containing said liquid, said method further comprising at least partially filling said vessel with said liquid, wetting said particulate solids with the same or a compatible liquid by feeding said particulate solids through said solid inlet and through said duct and allowing the wetted particulate solids to pass directly into said vessel.

9. A method as in claim 8 wherein the particulate solid is a polyectrolyte and the sprayed liquid and the liquid in said vessel are both water.

10. A method as in claim 9 wherein said particulate solids are injected into said duct with a swirling action.

11. A method as in claim 8 wherein said particulate solids are injected into said duct with a swirling action.

* * * * *